United States Patent [19]

Sabraw

[11] Patent Number: 4,989,662

[45] Date of Patent: Feb. 5, 1991

[54] DIFFERENTIAL PRESSURE, COUNTERGRAVITY CASTING OF A MELT WITH A FUGATIVE ALLOYANT

[75] Inventor: Richard J. Sabraw, Saginaw, Mich.

[73] Assignee: General Motors Corporation, Detroit, Mich.

[21] Appl. No.: 485,449

[22] Filed: Feb. 27, 1990

[51] Int. Cl.[5] ..... B22D 27/00; B22D 18/06

[52] U.S. Cl. ..... 164/58.1; 164/63; 164/255

[58] Field of Search ..... 164/55.1, 56.1, 57.1, 164/58.1, 59.1, 63, 119, 255, 306

[56] References Cited

U.S. PATENT DOCUMENTS

| | | | |
|---|---|---|---|
| 488,756 | 3/1976 | Nieman | 164/57.1 |
| 3,414,250 | 12/1968 | Snow | 266/34 |
| 3,703,922 | 11/1972 | Dunks et al. | 164/57.1 |
| 3,746,078 | 7/1973 | Moore et al. | 164/363 |
| 3,765,876 | 10/1973 | Moore | 75/130 |
| 3,819,365 | 6/1974 | McCauley | 75/130 |
| 3,870,512 | 3/1975 | Lee | 75/130 |
| 3,900,064 | 8/1975 | Chandley et al. | 164/51 |
| 3,971,433 | 7/1976 | Duchenne | 164/362 |
| 4,004,630 | 1/1977 | Dunks | 164/57.1 |
| 4,037,643 | 7/1977 | Mohia et al. | 164/58.1 |
| 4,040,821 | 8/1977 | Hetke et al. | 75/134 |
| 4,125,144 | 11/1978 | Kawamoto et al. | 164/4.1 |
| 4,210,195 | 7/1980 | McPherson | 164/57.1 |
| 4,312,688 | 1/1982 | Mannion et al. | 75/130 |
| 4,330,024 | 5/1982 | Wallace | 164/56.1 |
| 4,337,816 | 7/1982 | Kaku | 164/58.1 |
| 4,340,108 | 7/1982 | Chandley et al. | 164/63 |
| 4,606,396 | 8/1986 | Chandley et al. | 164/255 |
| 4,638,846 | 1/1987 | Ackerman et al. | 164/55.1 |

FOREIGN PATENT DOCUMENTS

| | | |
|---|---|---|
| 56-11151 | 9/1981 | Japan . |
| 60-196259 | 10/1985 | Japan . |

*Primary Examiner*—Kuang Y. Lin

*Attorney, Agent, or Firm*—Reising, Ethington, Barnard, Perry & Milton

[57] ABSTRACT

Apparatus and method for the differential pressure, countergravity casting of a melt of molten metal, such as nodular iron, containing a fugative alloyant, such as a magnesium nodularizing agent, susceptible to rapid loss from the melt over time wherein a source of the alloyant is so disposed on a lower portion of each mold as to contact the melt and replenish the alloyant content thereof when the lower mold portion of each mold is immersed in the melt for casting. An effective level of alloyant is thereby maintained in the melt throughout the casting of a plurality of molds in succession from the melt.

16 Claims, 2 Drawing Sheets

DIFFERENTIAL PRESSURE, COUNTERGRAVITY CASTING OF A MELT WITH A FUGATIVE ALLOYANT

FIELD OF THE INVENTION

This invention relates to improved apparatus and method for the differential pressure, countergravity casting of a melt in such a manner as to replenish and maintain the content of a fugative alloyant in the melt above a predetermined effective level throughout the casting of successive molds.

BACKGROUND OF THE INVENTION

Vacuum countergravity casting methods, such as described in U.S. Pat. Nos. 3,900,064; 4,340,108 and 4,606,396, have been in use in the casting of steel, aluminum and gray cast iron for which the molten metal chemistry can be readily controlled and maintained during the time that successive molds are immersed in the melt and the melt drawn upwardly into each mold by application of a suitable negative differential pressure between the mold and the melt. However, in the casting of nodular iron, a highly volatile, fugitive, nodularizing agent, such as magnesium, is required in the melt to effect desired spheroidization of the carbon therein during the casting process. In attempts to cast nodular iron parts using the vacuum countergravity processes described in the aforesaid patents, prior art workers have experienced great difficulty in maintaining the proper concentration (i.e., at least 0.02 percent by weight) of magnesium in the melt over the extended time required to cast a plurality of molds in succession from the melt. This difficulty is attributable to the rapid evaporation of magnesium from the melt following an initial treatment of the melt with a magnesium-bearing nodularizing agent. Erratic, uncontrolled loss (also known as fade) of the fugitive magnesium from the melt over time has been experienced and resulted in off-chemistry melts in so far as magnesium content is concerned and correspondingly inconsistent nodularization.

As a result of this inability to reliably control and maintain the melt chemistry (i.e., to maintain the magnesium content above the desired effective level) over the time required for casting a plurality of molds in succession, use of the countergravity casting processes described in the aforesaid patents in high volume production of nodular iron parts has been rendered impractical and/or uneconomical to date. In this regard, it is desirable to cast for at least five minutes before replacing the melt in the underlying pool. Magnesium fade over this period can be as much as 0.075% by weight unless some means can be provided to keep the magnesium concentration up during that period.

It is an object of the present invention to provide an improved apparatus and method for the differential pressure, countergravity casting of a molten metal, such as nodular iron, from a melt wherein the content of a fugative alloyant, such as a magnesium nodularizing agent, in the melt is reliably controlled over time throughout the casting of successive molds therefrom.

It is another object of the present invention to provide an improved apparatus and method for the differential pressure, countergravity casting of molten metal, such as nodular iron, wherein the mold includes a treating agent comprising the fugative alloyant so disposed thereon as to contact the underlying melt and replenish alloyant therein to maintain a desired effective concentration of alloyant for casting, thereby counteracting loss (or fade) of the alloyant from of the melt over time.

It is another object of the present invention to provide a method of making a countergravity casting mold in such a manner as to incorporate a treating agent comprising a fugative alloyant on the lower mold portion for introduction into the melt when the mold is immersed therein.

SUMMARY OF THE INVENTION

The present invention contemplates an improved apparatus and method for the differential pressure, countergravity casting of a molten metal containing a fugative alloyant susceptible to rapid loss or fade therefrom over the time required to cast a plurality of molds in succession. In particular, a treating agent comprising the fugative alloyant is disposed on a lower portion of each mold in such a manner as to contact the molten metal and replenish the alloyant content of the molten metal when the lower portion of each mold is immersed in the molten metal for casting. A preselected effective concentration of the alloyant (i.e., about 0.03–0.06% by weight) in the molten metal can thereby be maintained in the molten metal throughout the casting of a plurality of molds in succession.

Preferably, a source of the fugative alloyant is disposed on an underside of each mold adapted for immersion in the molten metal during casting. Preferably, the source of the fugative alloyant is partially embedded in the underside to so contact the molten metal as to replenish the dissolved alloyant concentration thereof when the lower mold portion is immersed for casting.

For the countergravity casting of nodular iron, the source of the fugative alloyant preferably comprises a magnesium-bearing nodularizing agent on the lower portion of each mold, preferably in the form of solid pellets located at multiple sites on the underside of the lower mold portion. The pellets contact the melt of molten iron during casting of each mold and replenish the dissolved magnesium concentration of the iron during the casting of each mold. A plurality of molds can thus be cast in succession while maintaining the desired concentration of magnesium in the melt for carbon nodularizing purposes.

The present invention also contemplates a method of making a casting mold having a surface with a source of alloyant thereon for contacting a molten metal to introduce the alloyant into the metal. In accordance with the method, a compliant mixture of particulate mold material and a settable binder is shaped to form a mold shape having the surface for contacting the molten metal, the source of alloyant to be introduced into the metal is partially embedded in the surface while the mixture is complaint and then the binder is set (for example, chemically or thermally) to rigidize the mold shape and retain the alloyant source embedded in the surface.

The aforementioned and other objects and advantages of the present invention will become more readily apparent from the detailed description thereof which follows.

BRIEF DESCRIPTION OF THE DRAWINGS

The present invention may be understood better when considered in light of the following detailed description of certain specific embodiments thereof taken in conjunction with the drawings wherein.

DETAILED DESCRIPTION OF SPECIFIC EMBODIMENTS

Figure 1:
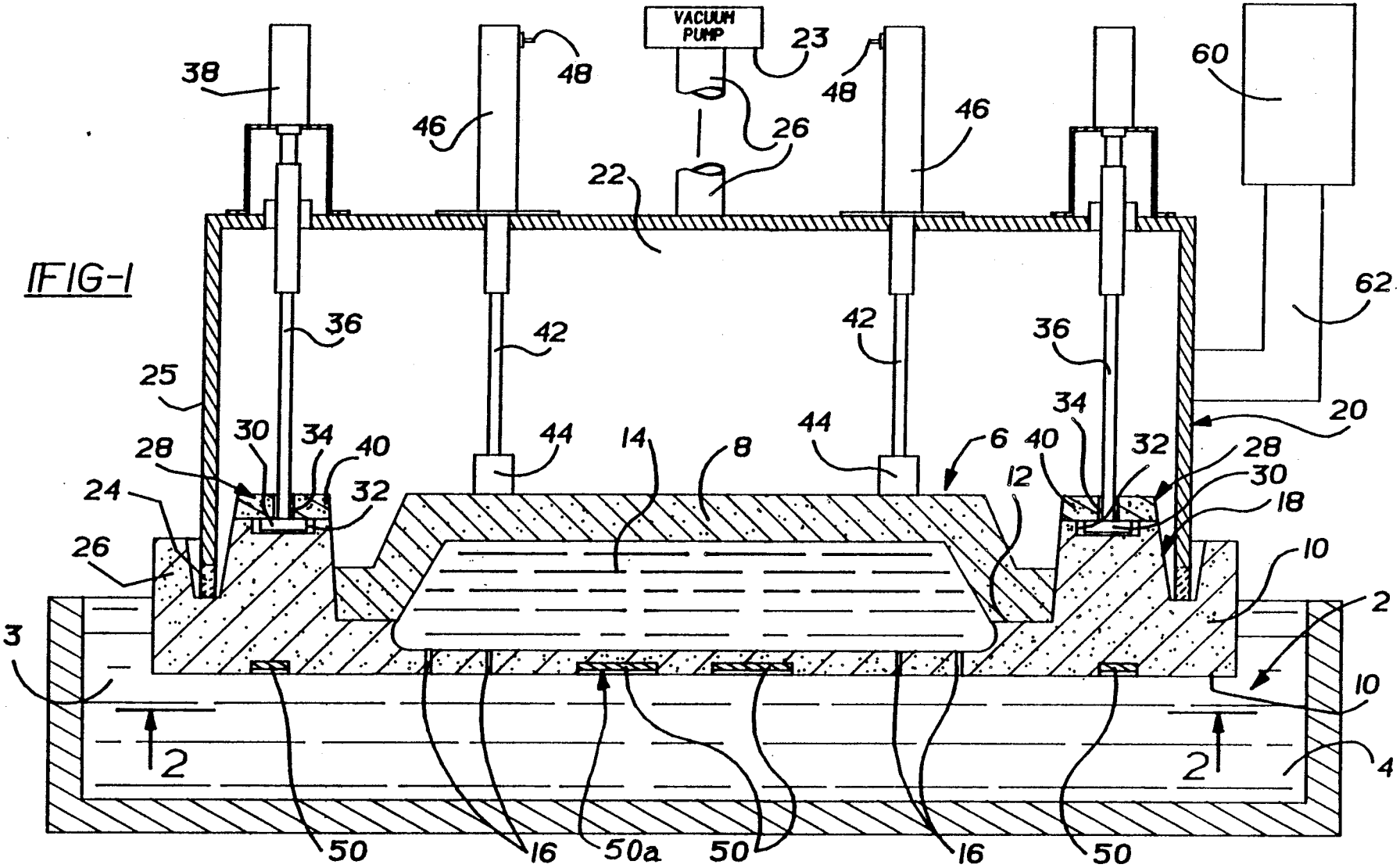
FIG. 1 is a sectioned, side view of a vacuum counter-gravity casting apparatus in accordance with the invention.

FIG. 1 depicts a pool 2 of melt 4 (e.g., molten iron) which is to be drawn up into a mold 6 having a gas-permeable upper mold portion 8 (cope) and a lower mold portion 10 (drag) joined at a parting line 12 and defining a molding cavity 14 therebetween. The melt 4 is contained in a casting furnace 3 heated by one or more induction coils (not shown) to maintain the melt 4 at a desired casting temperature; e.g., about 2600° F. to about 2650° F. for molten iron.

The lower mold portion 10 includes a plurality of ingates 16 communicating the underside 10*a* thereof with the mold cavity 14 for admitting the melt 4 to the mold cavity 14 when it is evacuated through the upper mold portion 8 with the underside 10*a* immersed in the melt 4. The lower mold portion 10 of the mold 6 is sealed to the mouth 18 of a vacuum box 20 defining a vacuum chamber 22 via a compressible seal 24 (e.g., high temperature rubber, ceramic rope, etc.). The seal 24 is affixed to the lower peripheral edge of the depending peripheral side 25 of the vacuum box 20. The vacuum chamber 22 encompasses the upper mold portion 8 and communicates with a vacuum source 23 (e.g., a vacuum pump) via conduit 26.

The upper mold portion 8 comprises a gas-permeable material (e.g., resin-bonded sand) which permits gases to be withdrawn from the casting cavity 14 therethrough when a vacuum is drawn in the chamber 22. The lower mold portion 10 may conveniently comprise the same material as the upper mold portion 8 or other materials, permeable or impermeable, which are compatible with the material of the upper mold portion 8. The lower mold portion 10 includes an upstanding levee 26 surrounding the seal 24 and isolating it from the melt 4 as described in U.S. Pat. No. 4,745,962 and assigned to the assignee of the present invention.

The lower mold portion 10 includes a plurality of anchoring sites 28 engaged by T-bar keepers 30 of the type described in commonly assigned U.S. patent application Ser. No. 147,863, abandoned in favor of patent application Ser. No. 286,051, providing means for mounting the mold 6 to the vacuum box 20. As described in those patent applications, the lower mold portion 10 includes a plurality of anchoring cavities 3 adapted to receive the T-bar keepers 30 via slots 34 in the shelves 40 overlying the anchoring cavities 32 and attached to the lower mold portion 10. A 90° rotation of the T-bar carrying shafts 36 (e.g., by air motors 38) causes the T-bar keepers 30 to engage the underside of the attached shelves 40 overhanging the cavities 32 to secure the mold 6 to the box 22. Other known mold to vacuum box mounting means can also be employed in practicing the invention (e.g., see U.S. Pat. No. 4,658,880).

The upper mold portion 8 is pressed into sealing engagement with the lower mold portion 10 (i.e., at the parting line 12) by means of a plurality of plungers 42 so as to eliminate the need to glue the upper mold portion 8 and the lower mold portion 10 at the parting plane 12. Feet 44 on the ends of the plungers 42 distribute the force of the plungers 42 more widely across the top of the upper mold portion 8 to prevent penetration/puncture thereof by the ends of the plungers 42. Pneumatic springs 46 bias the plungers 42 downwardly to resiliently press the upper mold portion 8 against the lower mold portion 10 as the mold 6 is being positioned in the mouth 18 of the vacuum box 22. Schrader valves 48 on the air springs 46 permit varying the pressure in the springs 46 as needed to apply sufficient force to press the upper mold portion 8 into sealing engagement with the lower mold portion 10, and, as needed, to prevent destructive inward flexure of the mold 6 when the casting vacuum is drawn. The force applied by the plungers 42, however, will not be so great as to overpower and damage the anchoring sites 28, dislodge the mold 6 from the mouth 18 of the box 20, or break the seal formed thereat.

In accordance with one embodiment of the invention for casting a melt 4 of nodular iron, a plurality of solid pellets 50 of a magnesium-bearing nodularizing agent (treating agent) are disposed externally on the lower portion 10 of each mold 6, preferably on the underside 10*a* thereof, to provide an expendable source of magnesium alloyant at multiple sites on the lower mold portion 10. The pellets 50 are so disposed on the underside 10*a* as to contact the melt 4 during immersion of each mold 6 in the melt 4 during casting and replenish the dissolved magnesium content of the melt 4 to a preselected effective level for nodularizing the iron.

For casting nodular iron, the pellets 50 preferably comprise iron-silicon-magnesium having a nominal composition of about 5 w/o Mg and balance equal amounts of Fe and Si, although other known nodularizer compositions can be used e.g., Ni—Mg, Si—Ca—Mg, Si—Ce—Mg and the like. The number and size and thus quantity (weight) of the pellets 50 disposed on the underside 10*a* of each mold 6 is so chosen as to replenish the dissolved magnesium content of the melt 4 to at least a preselected effective level for nodularizing the molten iron to be cast into the mold. In this regard, magnesium levels of at least about 0.02 w/o and preferably about 0.03–0.06 w/o of the melt should be maintained for adequate nodularization. Any fading or lose of the magnesium from the melt 4 over a given time period (e.g., five minutes) required to vacuum counter-gravity cast a plurality (e.g., twenty) of the molds 6 in succession from the melt 4 can thereby be counteracted as will be explained in more detail hereinbelow.

Figure 2:
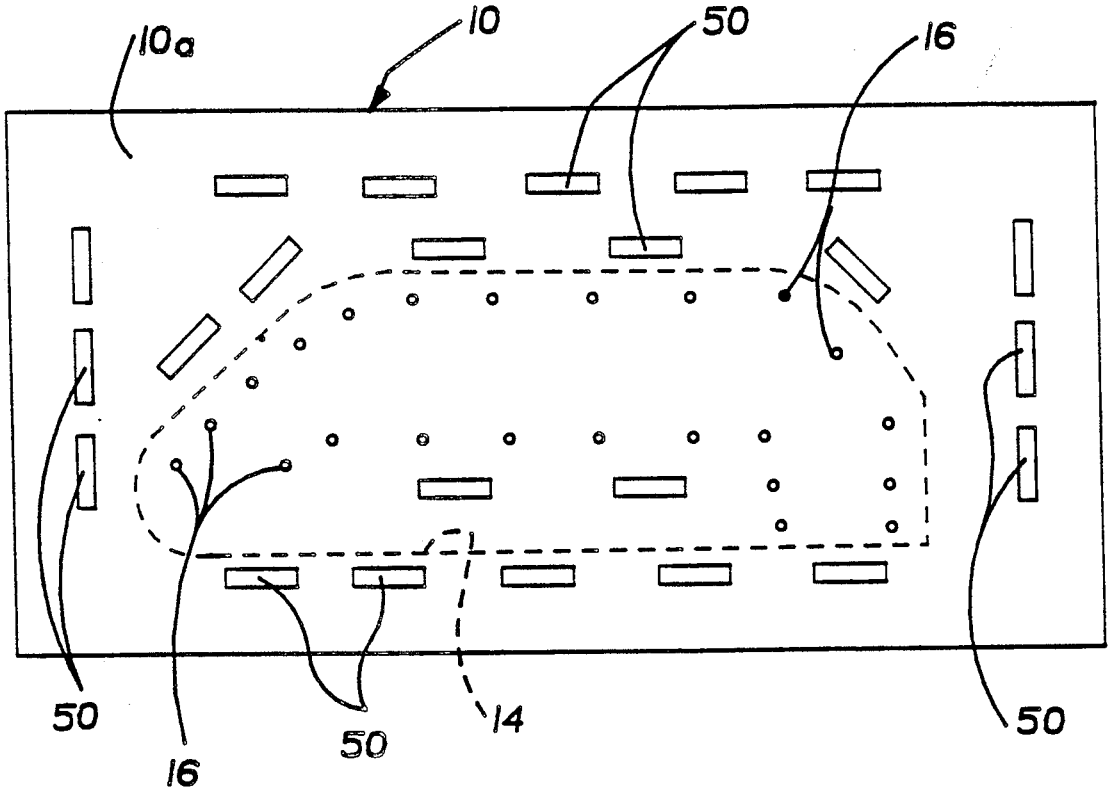
FIG. 2 is a bottom elevation of the casting mold drag taken in the direction of arrows 2—2.

A particular pattern of placement of the pellets 50 on the underside 10*a* is shown in FIG. 2, although the invention is not limited in this respect (i.e., other patterns of placement may be used), and indeed congregating all the pellets 50 together in a central location on the underside 10a has also proven to be quite effective. Moreover, as described in copending application Ser. No. 485,969 of common assignee herewith, the teachings of which are incorporated herein by reference, the pellets 50 may be selectively positioned on the underside 10*a* in such close proximity to one or more ingates 16 as to also introduce the alloyant into the molten metal drawn upwardly through the ingates 16 in order to treat the molten metal as it flows into those ingates, for example, to provide a casting with particular alloyant additions and/or different metallurgical characteristics throughout the casting or at different locations of the casting.

The pellets 50 are preferably incorporated in the underside 10*a* of each mold 6 during manufacture of the lower mold portion 10. For example, as mentioned hereinabove, the upper mold portion 8 and the lower mold portion 10 can be made of resin-bonded sand. In accordance with known mold practice, a compliant (shapeable) mixture of sand or equivalent particles and a settable binder material (e.g., an inorganic or organic thermal or chemical setting plastic resin) is formed to shape and then cured or hardened against a contoured metal pattern (not shown) having the desired complementary contour or profile for the parting surfaces and the mold cavity. However, prior to full curing/hardening of the binder (preferably prior to initiation of curing/hardening) while the mixture is compliant, the pellets 50 are embedded in the underside 10*a* of the lower mold portion 10; e.g., as shown in FIG. 1. Excess sand is then tamped against the outer peripheries of the pellets 50. Thereafter, the mixture of sand and binder material is cured (e.g., gas cured) or hardened in the usual manner known to those skilled in the art to rigidize the upper and lower mold portions 8,10. Curing or hardening of the lower mold portion 10 retains the pellets 50 embedded in the underside 10*a* thereof with at least one surface 50*a* of each pellet 50 exposed. The fully cured or hardened upper and lower mold portions 8,10 are then assembled and the resulting casting mold 6 is positioned above the melt 4 in the caster furnace 3.

The melt 4 is typically pretreated in conventional fashion in a separate holding furnace or ladle (not shown) to provide an initial effective concentration of magnesium throughout the melt 4 for carbon nodularizing purposes. For example, the melt 4 is typically initially treated (i.e., inoculated) using a conventional Fe—Si—Mg nodularizing agent as described above in a ladle (not shown). This treatment will provide an initial magnesium concentration in the melt of about 0.015% by weight. Thereafter, a charge of the treated melt is transferred to the casting furnace 3 for casting over time into each of a plurality of molds 6 successively immersed in the melt 4 in accordance with known vacuum countergravity casting techniques.

Countergravity casting of each casting mold 6 is effected by relatively moving each mold and the pool 2 to immerse the underside 10*a* of the lower mold portion 10 in the melt 4 and evacuating the mold cavity 14 to draw the molten iron upwardly thereinto. Typically, the casting mold 6 is lowered toward the pool 2 using a hydraulic power cylinder 60 (shown schematically) actuating a movable support arm 62 (shown schematically) that is connected to the vacuum box 20. When the underside 10*a* of the lower mold portion 10 is immersed in the melt 4, the solid magnesium-bearing pellets 50 react with the melt 4 to introduce magnesium into the melt 4 and counter any fading (i.e., loss) of magnesium from the time of initial treatment in the holding furnace to the time of mold immersion and thereafter during the time between the casting of each successive mold 6. In this way, the magnesium content of the melt 4 is replenished and maintained within an effective concentration range for nodularizing the carbon of the melt 4 throughout the casting of a plurality of molds 6 in succession.

As mentioned hereinabove, the quantity of magnesium ferro silicon (in the form of pellets 50) on the underside 10*a* of each lower mold portion 10 is selected to increase the magnesium content of the melt 4 to a level effective to nodularize the carbon in the melt. As those skilled in the art will appreciate, the quantity of magnesium to be added to the melt 4 will depend on the rapidity of fading of magnesium in the melt, the quantity of iron being cast as well as the carbon concentration of the iron, the time interval between initial treatment in the holding vessel and casting of the first mold as well as the time interval between the casting of successive remaining molds and can be determined empirically for any given casting application.

During the casting of the plurality of the molds 6 in succession, the induction coil (not shown) is energized to heat the melt 2 in the caster furnace 3 and maintain the desired melt casting temperature. This induction heating is advantageous to provide a mixing action in the melt 4 that enhances distribution of the magnesium throughout the melt 4.

After filling of each mold cavity 14 with the treated melt 4 and initial solidification of the melt in the ingates 16, each casting mold 6 is raised by hydraulic power cylinder 60 to withdraw the underside 10a of the lower mold portion 10 out of the pool 2. The number and size of the ingates 16 to achieve metal solidification initially at the ingates 16 can be selected in accordance with the teachings of U.S. Pat. No. 4,340,108. Alternatively, the molten iron can be allowed to solidify in both the ingates 16 and the mold cavity 14 before raising the casting mold.

Following withdrawal of each metal-filled mold 6 from the pool 2, the mold is transferred to an unloading station (not shown) where the vacuum box 20 and the mold are separated. Another casting mold 6 is then positioned in and sealed to the vacuum box 20 and the casting method described hereinabove is repeated for that mold.

The invention thus provides an apparatus and method for prolonging the useful life of the melt 4 (i.e., by replenishing and controlling the magnesium content thereof) in such a manner as to enable the casting of a plurality of the molds 6 in succession over an extended time period required in high production casting applications.

Although the invention has been described in detail hereinabove with respect to the differential pressure, countergravity casting of nodular iron, those skilled in the art will appreciate that the invention is not limited to casting nodular iron and may find use in the differential pressure, countergravity casting of other metals and alloys that contain or are treated with a fugative alloyant that is rapidly lost from the melt for one reason or another over time and where there is a need to maintain an effective concentration of the alloyant in the melt.

While the invention has been described in terms of specific embodiments thereof, it is not intended to be limited thereto but rather only to the extent set forth hereafter in the claims which follow.

I claim:

1. Apparatus for the differential pressure countergravity casting of molten metal containing a fugative alloyant susceptible to rapid loss from the molten metal, comprising:

(a) means for successively immersing a plurality of molds in a pool of said metal underlying said molds, each said mold having a mold cavity and an ingate communicating the mold cavity with a lower mold portion adapted for immersion in said pool, (b) means for applying a differential pressure between the mold cavity and the pool sufficient to urge the molten iron upwardly through the ingate into the mold cavity while a said mold is immersed in said pool; and (c) a treating agent comprising said alloyant disposed on an external surface of the lower mold portion of each mold so as to contact the molten metal when the lower mold portion is immersed in the pool and maintain a concentration of said alloyant in said molten metal above a predetermined effective level throughout the successive immersions of said molds.

2. The apparatus of claim 1 wherein said treating agent is embedded in said lower mold portion.

3. The apparatus of claim 1 wherein said treating agent is located at a plurality of sites on an underside of said mold.

4. The apparatus of claim 1 wherein said metal comprises nodular iron and said treating agent comprises magnesium.

5. Apparatus for the vacuum-assisted countergravity casting of nodular iron, comprising:

(a) means for successively immersing a plurality of molds in a pool of said iron underlying said molds, each said mold having a gas permeable upper portion at least in part defining a mold cavity and a lower portion including at least one ingate communicating the mold cavity with an underside of said lower portion, said underside being adapted for immersion in the pool of molten iron, (b) a carbon nodularizing agent disposed externally on the underside of the said lower portion of each mold to so contact the molten iron when the underside is immersed in the pool as to introduce the nodularizing agent into the molten iron, (c) means for relatively moving the mold and the pool to immerse said underside in the pool and contact said noularizing agent and said molten iron, and (d) means for evacuating the mold cavity sufficiently to urge the molten iron upwardly through the ingate into the mold cavity.

6. The apparatus of claim 5 wherein said nodularizing agent is embedded in said underside.

7. The apparatus of claim 5 wherein said nodularizing agent includes magnesium.

8. In a method for the differential pressure countergravity casting of molten metal containing a fugative alloyant susceptible to rapid loss from the molten metal, comprising the-principal steps of forming a mold having a mold cavity and an ingate communicating the mold cavity with a lower mold portion adapted for immersion in an underlying molten metal pool, relatively moving the mold and the pool to immerse said lower mold portion in said pool, and applying a differential pressure between the mold cavity and the pool sufficient to urge the treated molten metal upwardly through the ingate into the mold cavity, the improvement comprising maintaining the concentration of said alloyant in said pool above a predetermined effective level by:

(a) disposing a treating agent comprising said alloyant on said lower portion; and (b) contacting said treating agent and said molten metal upon immersion of said mold in said pool.

9. The method of claim 8 including embedding the treating agent in an underside of said mold.

10. The method of claim 8 wherein said metal comprises nodular iron and the treating agent comprises a carbon nodularizing agent.

11. A method for the successive differential pressure countergravity casting of a single charge of nodular iron into a plurality of molds, comprising the steps of:

(a) forming each mold with a mold cavity, an ingate communicating the mold cavity with a lower mold portion adapted for immersion in an underlying molten pool of said iron and, a carbon nodularizing agent disposed externally on the lower mold portion so as to contact the molten iron when said lower mold portion is immersed in said pool, (b) relatively moving the molds and the pool to immerse each said lower mold portion and nodularizing agent in said pool so as to replenish any nodularizing agent otherwise lost from said molten iron during the casting of said plurality of molds, and (c) for each mold, applying a differential pressure between the mold cavity and the pool sufficient to urge the molten iron upwardly through the ingate into the mold cavity.

12. A method for the vacuum-assisted countergravity casting of nodular iron, comprising the steps of:

(a) forming a mold having a gas permeable upper portion at least in part defining a mold cavity and having a lower portion with at least one ingate communicating the mold cavity with an underside of said lower portion, including disposing a carbon nodularizing agent externally on said underside so as to contact the molten iron when the underside is immersed in the pool, (b) relatively moving the mold and the pool to immerse said underside in the pool, including contacting said nodularizing agent and said molten iron so as to introduce said nodularizing agent into said molten iron, and (c) evacuating the mold cavity sufficiently to urge the molten iron upwardly through the ingate into the mold cavity.

13. The method of claim 12 including embedding said nodularizing agent in said underside.

14. A method for the vacuum assisted countergravity casting of nodular iron, comprising the steps of:

(a) forming a melt of molten iron having a quantity of a nodularizing agent dissolved therein, the quantity of said nodularizing agent in said melt decreasing over time as a result of volatization of said nodularizing agent, (b) disposing a mold above said melt, said mold having a mold cavity, an ingate communicating the mold cavity with a lower mold portion adapted for immersion in the underlying melt, and a solid nodularizing agent disposed on said lower mold portion so as to contact the molten iron when said lower mold portion is immersed in said melt, (c) relatively moving the mold and the melt to immerse said lower mold portion in said melt, including contacting the solid nodularizing agent and the melt so as to increase the quantity of dissolved nodularizing agent in said melt, and (d) evacuating the mold cavity sufficiently to urge the melt upwardly through the ingate into the mold cavity.

15. A method of making a casting mold having an external surface with a source of an alloyant thereon for so contacting a molten metal as to introduce the alloyant into the metal, comprising the steps of:

(a) shaping a compliant mixture of particulate mold material and a settable binder to form a mold shape having said surface, (b) embedding the source of the alloyant in said surface while said mixture is compliant, and (c) setting the binder after the source of said alloyant is embedded in said surface to rigidize the mold shape and retain said source embedded in said surface.

16. A method of making a countergravity casting mold having an external flat underside surface adapted for immersion in molten metal with said, surface having a source of an alloyant thereon for introduction into the metal upon contact therewith, comprising the steps of:

(a) shaping a compliant mixture of particulate mold material and a settable binder to form a mold shape having said flat underside, (b) embedding the source of the alloyant in said underside while said mixture is complaint, and (c) setting the binder after the source of the alloyant is embedded in said underside to rigidize the mold shape and retain said source embedded in said underside.

* * * * *

UNITED STATES PATENT AND TRADEMARK OFFICE

CERTIFICATE OF CORRECTION

PATENT NO. : 4,989,662

DATED : February 5, 1991

INVENTOR(S) : Richard J. Sabraw

It is certified that error appears in the above-identified patent and that said Letters Patent is hereby corrected as shown below:

Column 2, line 3, after "from" delete --of--.

Column 2, line 56, delete "complaint" and insert --compliant-- therefor.

Column 3, line 51, delete "3" and insert --32-- therefor.

Column 4, line 42, delete "lose" and insert --loss-- therefor.

Signed and Sealed this

Seventeenth Day of August, 1993

Bruce Lehman

*Attest:*

BRUCE LEHMAN

*Attesting Officer*

*Commissioner of Patents and Trademarks*